US010189688B2

(12) United States Patent
Borøy et al.

(10) Patent No.: US 10,189,688 B2
(45) Date of Patent: Jan. 29, 2019

(54) WINCH DRUM WITH INTERNAL WIRE STORAGE

(71) Applicant: National Oilwell Varco Norway AS, Kristiansand S (NO)

(72) Inventors: Yngvar Borøy, Søgne (NO); Thor Strand, Kristiansand (NO); Anders Eriksson, Fornebu (NO); Anibal B. Teixeira, Kristiansand (NO)

(73) Assignee: NATIONAL OILWELL VARCO NORWAY AS, Kristiansand S (NO)

( * ) Notice: Subject to any disclaimer, the term of this patent is extended or adjusted under 35 U.S.C. 154(b) by 0 days.

(21) Appl. No.: 15/544,431

(22) PCT Filed: Jan. 22, 2015

(86) PCT No.: PCT/NO2015/050014
§ 371 (c)(1),
(2) Date: Jul. 18, 2017

(87) PCT Pub. No.: WO2016/118015
PCT Pub. Date: Jul. 28, 2016

(65) Prior Publication Data

US 2018/0009641 A1 Jan. 11, 2018

(51) Int. Cl.
*B66D 1/26* (2006.01)
*B66D 1/30* (2006.01)
*B66D 1/34* (2006.01)

(52) U.S. Cl.
CPC ..... *B66D 1/26* (2013.01); *B66D 1/30* (2013.01); *B66D 1/34* (2013.01)

(58) Field of Classification Search
CPC . B66D 1/26; B66D 1/30; H02G 11/02; B65H 2701/34; B65H 75/38
See application file for complete search history.

(56) References Cited

U.S. PATENT DOCUMENTS 2,420,072 A * 5/1947 Foote ..... B63C 7/04 114/51
3,061,234 A * 10/1962 Morey ..... B65H 75/38 191/12.2 R (Continued)

FOREIGN PATENT DOCUMENTS

CN 201193195 Y 2/2009
SU 656958 4/1979

(Continued)

OTHER PUBLICATIONS

English Abstract of Chinese Application No. CN201193195 (1 page).

(Continued)

*Primary Examiner* — Michael E Gallion
(74) *Attorney, Agent, or Firm* — Conley Rose, P.C.

(57) ABSTRACT

A winch drum device includes a first winch drum with an outer surface adapted to accommodate axially displaced turns of wire rope and further includes a wire rope storage means, such as a recess, extending at least partially radially in from said outer surface. The wire rope storage means is adapted to accommodate one or more layers of the wire rope.
The winch drum device may be incorporated into a winch.

16 Claims, 7 Drawing Sheets

(56) References Cited

U.S. PATENT DOCUMENTS 3,128,857 A * 4/1964 Walton ..... B65H 75/4455 191/12.2 R
3,144,218 A * 8/1964 Tepe ..... B65H 75/4449 191/12.2 A
3,226,090 A * 12/1965 Sauerbrey ..... B66D 1/36 242/397.3
3,252,672 A * 5/1966 Scott ..... B66D 1/005 242/392
3,539,123 A * 11/1970 Shutt ..... B65H 75/4449 242/386
3,582,011 A * 6/1971 Murray ..... B21C 47/323 242/125.1
3,614,692 A * 10/1971 Rozelle ..... H01F 29/12 219/210
3,814,213 A * 6/1974 Balass ..... F03G 1/00 16/198
3,822,834 A * 7/1974 Fjarlie ..... B65H 75/4452 242/386
4,010,913 A * 3/1977 Guerster ..... B65H 75/38 242/378.1
5,335,874 A * 8/1994 Shrum ..... B65H 75/22 242/118.4
7,487,932 B2 * 2/2009 Ellis ..... B65H 75/148 242/125.2
8,727,084 B1 * 5/2014 Kuker ..... B65H 75/425 191/12.2 R
9,440,817 B2 * 9/2016 Zink ..... B65H 75/38
9,939,600 B2 * 4/2018 Holmberg ..... G02B 6/4457
2010/0224844 A1 * 9/2010 Boussaton ..... B66D 1/26 254/290
2012/0205477 A1 * 8/2012 Whitaker ..... H02G 11/02 242/378
2013/0003496 A1 * 1/2013 Berg ..... H02G 1/10 367/15
2013/0284843 A1 * 10/2013 Mertesdorf ..... B65H 75/4402 242/397
2014/0199152 A1 * 7/2014 Roodenburg ..... B66D 1/7405 414/800
2015/0097148 A1 * 4/2015 Wiley ..... B66D 1/34 254/266
2015/0375975 A1 * 12/2015 Flateland ..... B66D 1/7405 254/310

FOREIGN PATENT DOCUMENTS

SU 872444 10/1981
WO 2014209131 12/2014

OTHER PUBLICATIONS

Published PCT Application No. PCT/NO2015/050014 with International Search Report published Jul. 28, 2016 (17 pages).
Written Opinion for PCT Application No. PCT/NO2015/050014 dated Sep. 4, 2015.

* cited by examiner

C-C

7a

7b

WINCH DRUM WITH INTERNAL WIRE STORAGE

CROSS REFERENCE TO RELATED APPLICATIONS

This application is the U.S. National Stage entry under 35 U.S.C. § 371 of International Patent Application No. PCT/NO2015/050014, filed Jan. 22, 2015, and entitled "Winch Drum With Internal Wire Storage," which is hereby incorporated by reference in its entirety for all purposes.

TECHNOLOGICAL FIELD

This present disclosure relates to a winch drum device. More particularly it relates to a winch drum device comprising a first winch drum with an outer surface adapted to accommodate a plurality of axially displaced turns of wire rope in a first position of use of the winch drum device, the winch drum device being provided with wire rope storage means. The present disclosure also relates to a winch comprising a winch drum device.

BACKGROUND

Winches used in the hoisting of loads are getting increasingly large due to requirements for lifting heavier loads. In particular, winches used on drilling rigs for hoisting top drives and pipe strings tend to get larger in order to satisfy the increased load requirements. In certain applications it might be necessary to lift several thousand tons. Recently, there has been a desire to deploy winches that accommodate only a single or a few layers of wire rope on the winch drum, primarily to reduce wear on the wire rope from overlaying layers. In order to have available sufficient length of wire rope on the winch drum, the winch drum needs to be made larger, both in diameter and in the axial direction. Hence, a single layer winch, or a winch with only a very few layers of wire rope, tends to take up more space. It might also be desirable to run a plurality of wire ropes in parallel, for instance due to security reasons, which will make the axial space requirements even more pronounced. Space on drilling rigs, ships etc. where the winch typically is to be used is often restricted. Use of single layer winches drilling rig hoisting systems with several parallel wire ropes was described in patent application PCT/NO2014/050113, incorporated herein in its entirety by this reference. International winch standards require three to five wire rope safety turns as a backup and safety measure. These safety turns increase the required length of a winch drum even more, especially for single layer winches.

The present disclosure has for its object to remedy or to reduce at least one of the drawbacks of the prior art, or at least provide a useful alternative to prior art by employing features that are specified in the description below and in the claims that follow.

BRIEF SUMMARY OF THE DISCLOSURE

In a first aspect, the present disclosure relates to a winch drum device comprising:

a first winch drum with an outer surface adapted to accommodate a plurality of axially displaced turns of wire rope, wherein the winch drum device is provided with wire rope storage means, such as a recess, extending at least partially radially in from said outer surface of the first winch drum, and where the wire rope storage means is adapted to accommodate one or more turns of the wire rope.

The one or more layers of wire rope in the wire rope storage means may be at least partially radially displaced, so that the one or more turns of wire ropes may be at least partially placed on top of each other. This may save space on the winch drum device, and the first winch drum may be made shorter in the axial direction. The turns of wire rope accommodated by the wire rope storage means may be the so-called safety turns.

In one embodiment, the first winch drum may be adapted to accommodate only a single layer of wire rope. The use of single layer winch drums may significantly reduce wear on the wire rope, as was also described in the above-mentioned patent application assigned to the present applicant. The use of only a single layer of wire rope may require a larger winch drum, both in length and diameter, to accommodate sufficient length of wire rope. It may thus be beneficial, as also described is the mentioned patent application, to reduce the number of sheaves in the draw-works so as to reduce the mechanical advantage, but at the same time increasing the size of the sheaves to reduce the required travelling length of the wire rope and to reduce wear.

In one embodiment, the first winch drum may be adapted to accommodate a plurality of parallel wire ropes, and wherein said first winch drum is formed with a plurality of said wire rope storage means appurtenant the plurality of wire ropes, implying that each of the parallel wire ropes may have its own wire rope storage means, such as a recess/pocket, in the winch drum. It has been found that it is possible to shorten the required length of the winch drum by several meters by hiding turns of each of the parallel wire ropes in the winch drum. In one embodiment, an end of each wire rope may be anchored to the first winch drum in its appurtenant wire rope storage means. The one or more parallel wire ropes may be anchored to the winch drum by means of wire clamps in the wire rope storage means as will be known to a person skilled in the art.

In one embodiment, the first winch drum may be constituted by a removable shell, wherein the winch drum device with said removable shell may define a first position of use for the winch drum device. Further, the winch drum may be provided with a second, smaller diameter winch drum, inside the first, removable winch drum, adapted to accommodate a plurality of layers of wire rope in a second position of use for the winch drum device with said removable shell having been removed. By having a first, outer winch drum that is removable and a second, inner winch drum that may accommodate a plurality of layers of wire rope, the winch drum device may be transformed from a single layer winch, using the first winch drum, to a multilayer winch, with first winch drum, i.e. the removable shell, removed. This may make one and the same winch suitable for multiple operations, such as hoisting of loads on a vessel or rig in the first position of use, and for hoisting loads into deep waters in a second position of use. This dual functionality arrangement may save both time and space in offshore operations.

In one embodiment, the wire rope storage means may be reinforced, meaning that the wire rope storage means may be provided as a reinforced part of the first winch drum itself, which may make the winch drum device more robust.

In one embodiment, said reinforced wire rope storage means may extend sufficiently radially in from said removable shell to abut said second winch drum of the winch drum device so as to support said removable shell. The wire rope storage means thus may function as a combined means for storing the one or more layers of wire rope, while at the same time functioning as support means for the removable shell.

In one embodiment, said wire rope storage means may be connected to the winch drum by means of welding and/or press fitting, which may provide a particularly solid and accurate connection between the winch drum and the wire rope storage means in an embodiment where these are provided as separate parts. In another embodiment, the wire rope storage means and the first winch drum may be machined as one part.

In a second aspect, the present disclosure relates to a winch comprising a winch drum device as described generally above and specified in greater detail below.

BRIEF DESCRIPTION OF THE DRAWINGS

In the following is described an example of a preferred, non-limiting, embodiment illustrated in the accompanying drawings, wherein.

DETAILED DESCRIPTION OF THE DISCLOSED EXEMPLARY EMBODIMENTS

Figure 1:
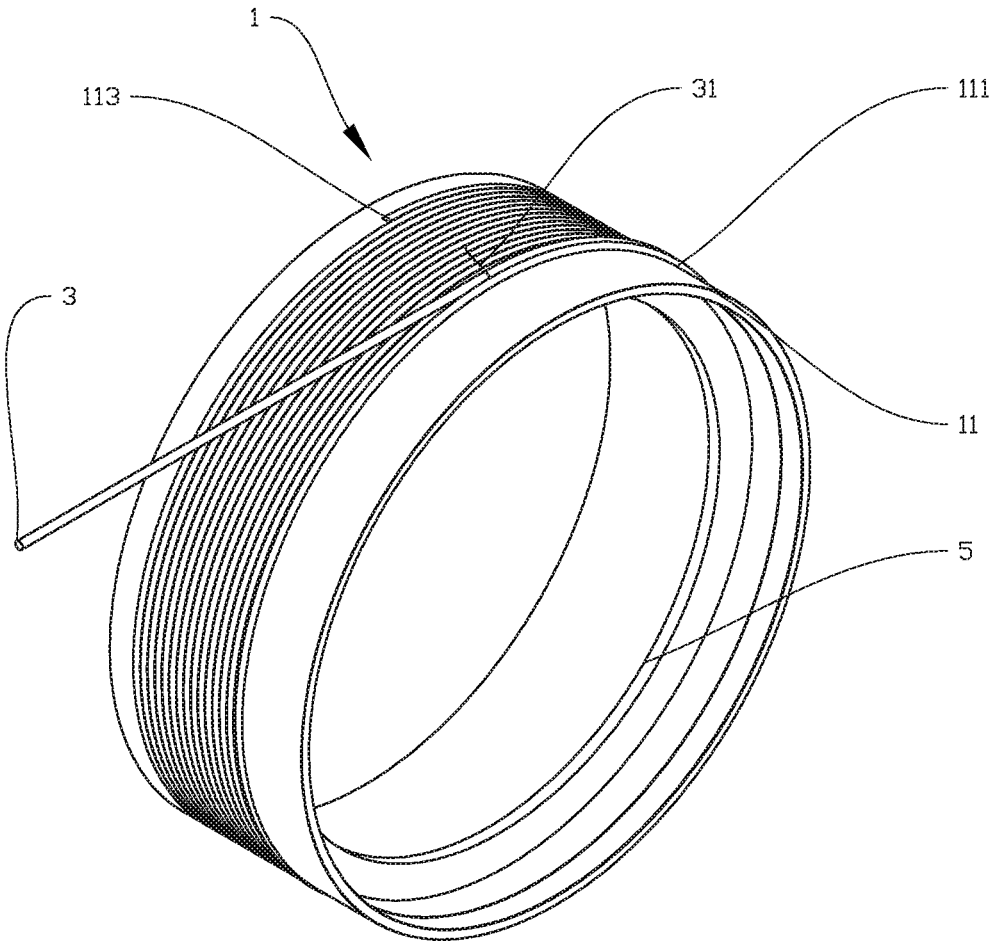
FIG. 1 shows, in a perspective view, a winch drum device according to the present disclosure and principles described herein.

In the following, reference numeral 1 will refer to a winch drum device according to the first aspect of the present disclosure, whereas reference numeral 10 will denote a winch according to the second aspect of the present disclosure. The drawings may be shown schematically and simplified and they are not necessarily to scale.

Figure 2:
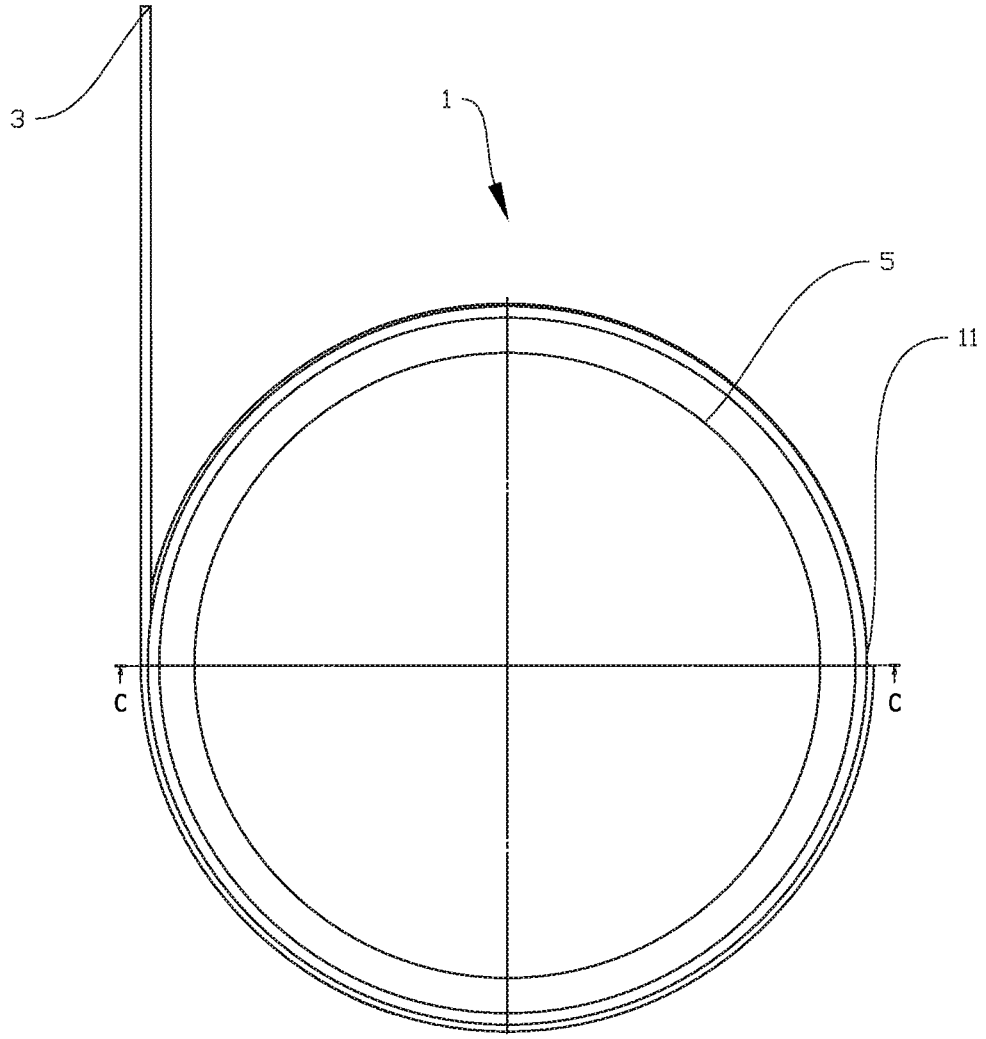
FIG. 2 shows; in a side view, the winch drum device from FIG. 1.
Figure 4:
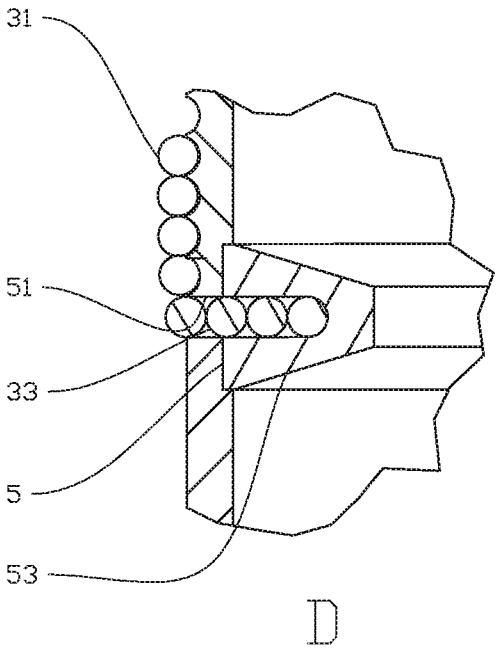
FIG. 4 shows, in a side view, an enlarged part of FIG. 3.

FIG. 1 shows a winch drum device 1 according to the first aspect of the present disclosure in its simplest form. In the figure, one wire rope 3 is coiled around an outer surface 111 of a first winch drum 11 so that multiple axially displaced turns 31 of wire rope 3 are stored on the winch drum 11 in a helical groove 113 thereof. The winch drum device 1 is provided with a wire rope storage means 5 in the form of a pocket connected to the first winch drum 11 and with its opening provided as a slot 51, as best seen in FIG. 4, in the outer surface 111 of the winch drum 11. The pocket 5 is adapted to accommodate a plurality of radially displaced turns 33 of wire rope 3, as can best be seen in FIG. 4. FIG. 2 is a side view of the winch drum device 1. In use, as will be described with reference to FIG. 5 below, the winch drum device may be made longer to accommodate a plurality of parallel wire ropes 3, 3', 3", 3'".

Figure 3:
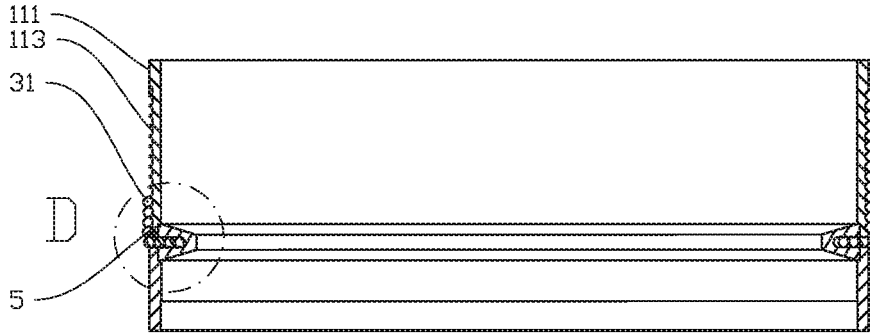
FIG. 3 shows, in a cross-sectional view, the winch drum from FIGS. 1 and 2.

FIG. 3 is a cross-section as seen through the line C-C of FIG. 2, whereas FIG. 4 shows an enlarged view of detail D from FIG. 3, including the pocket 5 and the radially displaced turns 33 of wire 3 stored therein. In the shown embodiment, the pocket 5 is adapted to accommodate four radially displaced turns 33 of wire rope 3, which typically will be the so-called safety turns discussed above, meaning that these turns of wire rope 3 will not be engaged during regular operations, but serve as a backup in case of failure. It can also be seen in FIG. 4 that the pocket 5 is provided as a reinforced part 53 of the first winch drum 11 which is connected to the winch drum 11 by means of welding and press-fitting.

Figure 5:
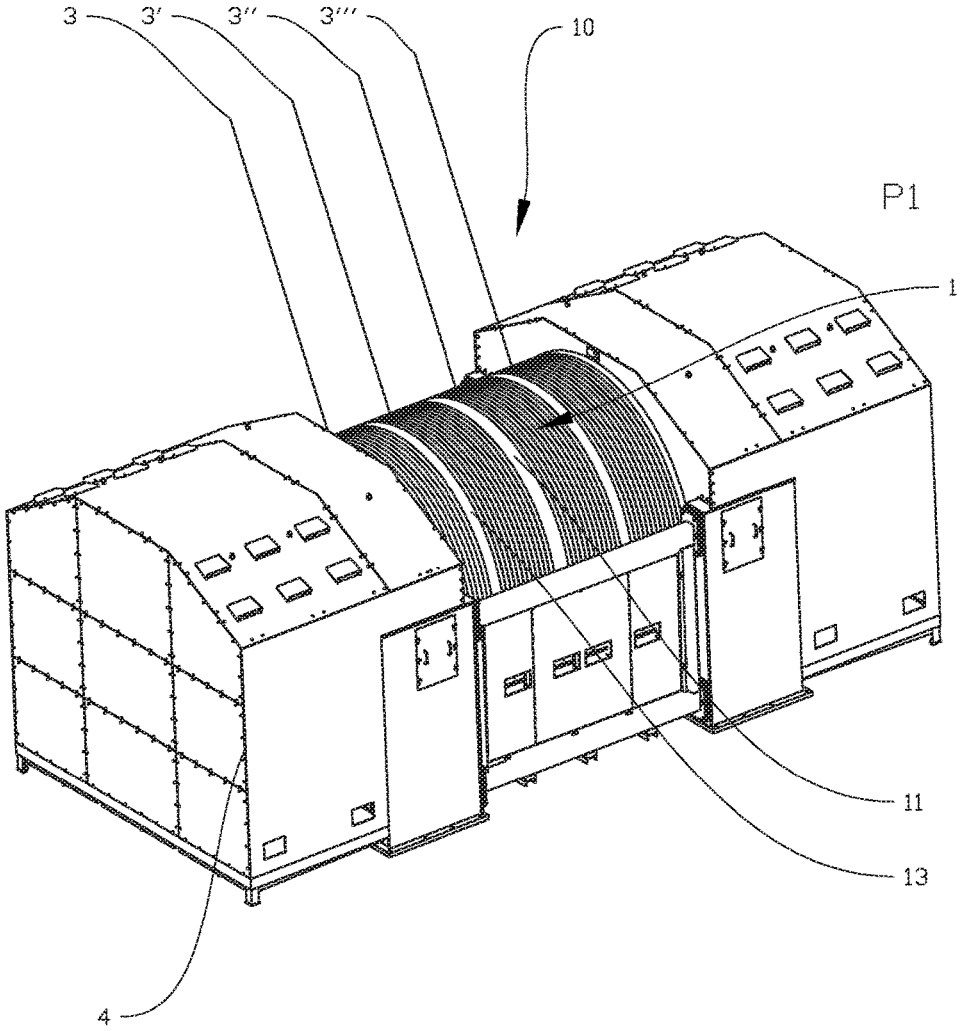
FIG. 5 shows, in perspective view, a winch according to the present disclosure in a first position of use.

FIG. 5 shows a winch 10 according to the second aspect of the present disclosure. The winch 10 comprises a housing 4 covering the ends of the winch drum 11 in the figure. The winch 10 runs four parallel wire ropes 3, 3', 3", 3'" connected to a first winch drum 11 of a winch drum device 1 according to the present disclosure. The first winch drum 11 is provided with four wire rope storage means 5, not visible in this figure, one for each wire rope 3, 3', 3", 3'". The winch 10 and the winch drum device 1 are shown in a first position of use P1, wherein the first winch drum 11 is adapted to accommodate single layers of the wire ropes 3, 3', 3", 3'", as it will typically be used in hoisting of drilling equipment and pipes on a rig or on a vessel. The first winch drum 11 is constituted by a removable shell 13.

Figure 6:
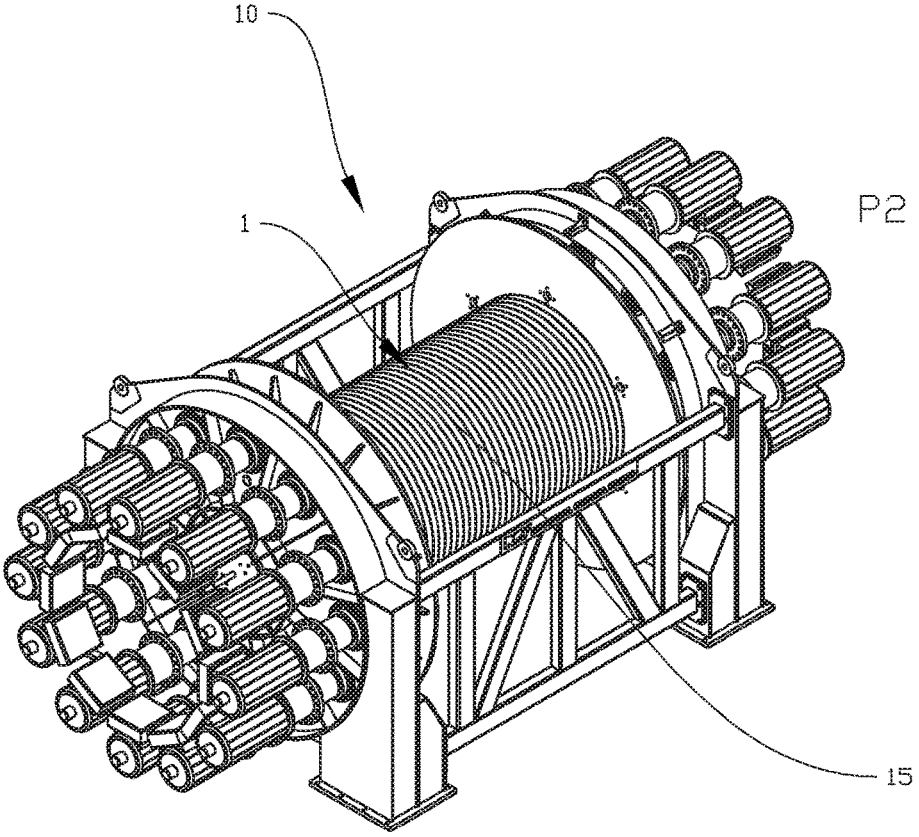
FIG. 6 shows, in a perspective view, a winch according to the present disclosure in a second position of use.

In FIG. 6, the winch housing 4 has been removed for the overview. Further, the removable shell 13 has been removed in order to reveal a second winch drum 15 with a smaller diameter than the first winch drum 11. This corresponds to a second position P2 of use for the winch drum device 1. In this second position of use P2 the winch drum device is adapted to accommodate a plurality of layers of not shown wire rope, whereby the winch 10 may also be used in operations requiring hoisting of loads over large heights, such as in deep water applications.

Figure 7:
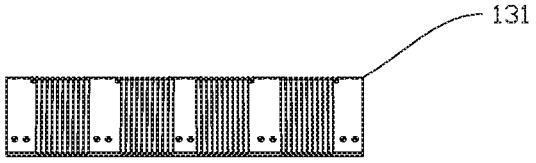
FIG. 7 shows, in a side view, segments belonging to a removable shell of a winch drum device according to the present disclosure.
Figure 7:
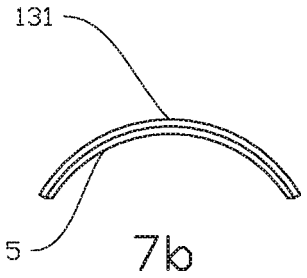

FIG. 7 shows a shell segment 131 of the winch drum 11 from FIG. 5. The shell segment 131 is shown in a front view in sub-figure 7*a* and in a side view in sub-figure 7*b*. The shell segment 131 covers substantially 120 degrees of the removable shell 13 shown in FIG. 5, implying that three such shell segments 131 are needed to be connected in order to make up the first winch drum 1, i.e. the full removable shell 13. In alternative embodiments the removable shell 13 may be constituted by a different number of shell segments 131. One of the wire rope storage means 5 is visible in the side view in sub-figure 7*b*.

It should be noted that the above-mentioned embodiments illustrate rather than limit the present disclosure, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A winch drum device comprising:

a first winch drum having a central axis of rotation and a radially outer surface configured to accommodate a plurality of axially displaced turns of wire rope;

an annular recess extending radially inward from the radially outer surface of the first winch drum and extending about the circumference of the radially outer surface of the first winch drum;

wherein the annular recess is configured to accommodate one or more turns of the wire rope and the first winch drum is configured to rotate about the central axis of rotation to pay in and pay out the wire rope from the annular recess.

2. The winch drum device according to claim 1, wherein the first winch drum is configured to accommodate only a single layer of wire rope.

3. The winch drum device according to claim 1, wherein the first winch drum is configured to accommodate a plurality of parallel wire ropes, and wherein the first winch drum includes a plurality of annular recesses, wherein each annular recess extends radially inward from the radially outer surface of the first winch drum and extends circumferentially about the radially outer surface of the first winch drum, and wherein each annular recess is configured to accommodate one or more turns of one of the plurality of parallel wire ropes.

4. The winch drum device according to claim 3, wherein an end of each of the plurality of parallel wire ropes is anchored to the first winch drum in one of the plurality of annular recesses.

5. The winch drum device according to claim 1, wherein the first winch drum comprises a removable shell, wherein a second winch drum is disposed within the removable shell of the first winch drum, wherein the second winch drum is configured to accommodate a plurality of layers of wire rope, wherein the winch drum device with the removable shell and the second winch drum disposed therein defines a first position of use (P1) for the winch drum device.

6. The winch drum device according to claim 5, wherein in a second position of use (P2) for the winch drum device the removable shell is removed to expose the second winch drum.

7. The winch drum device according to claim 1, wherein the first winch drum comprises an annular shell and an annular wire rope storage member coupled to a radially inner surface of the annular shell, wherein the annular recess is defined by a slot in the annular shell and a pocket in the annular wire rope storage member.

8. The winch drum device according to claim 7, wherein the annular wire rope storage member extends radially inward from the annular shell and radially abuts a second winch drum disposed within the first winch drum.

9. The winch drum device according to claim 7, wherein the annular wire rope storage member is mechanically connected to the annular shell by fitting welded joint or a press fit connection.

10. A winch comprising:

a first winch drum having a central axis of rotation, wherein the first winch drum comprises an annular shell, an annular wire rope storage member attached to a radially inner surface of the annular shell, and an annular wire rope storage recess extending radially inward from a radially outer surface of the annular shell through the annular shell into the annular wire rope storage member, wherein the annular wire rope storage recess extends about the circumference of the first winch drum;

wherein the radially outer surface of the annular shell is configured to accommodate a plurality of axially displaced turns of wire rope;

wherein the annular wire rope storage recess is configured to accommodate one or more turns of the wire rope and the first winch drum is configured to rotate about the central axis of rotation to pay in and pay out the wire rope from the annular wire rope recess.

11. The winch of claim 10, further comprising:

a plurality of annular wire rope storage members attached to the radially inner surface of the annular shell;

a plurality of annular wire rope storage recesses extending circumferentially about the first winch drum, wherein each wire rope storage recess extends radially inward from a radially outer surface of the annular shell through the annular shell into one of the plurality of annular wire rope storage members;

wherein the radially outer annular shell of the first winch drum is configured to accommodate a plurality of parallel wire ropes, and wherein each of the annular wire rope storage recesses is configured to accommodate one of the plurality of wire ropes.

12. The winch of claim 11, wherein an end of each wire rope is anchored to the first winch drum in one of the plurality of annular wire rope storage recesses.

13. The winch of claim 10, wherein the annular shell of the first winch drum is removable.

14. The winch of claim 13, further comprising a second winch drum disposed within the first winch drum, wherein the second winch drum is configured to accommodate a plurality of layers of wire rope, wherein the winch has a first position of use (P1) with the annular shell disposed about the second winch drum and a second position of use (P2) with the annular shell removed to expose the second winch drum.

15. The winch of claim 13, wherein the annular wire rope storage member extends radially inward from the annular shell and radially abuts a second winch drum disposed within the first winch drum so as to provide support for the annular shell.

16. The winch of claim 15, wherein the annular wire rope storage member is mechanically connected to the annular shell by a welded joint or a press fit joint.

* * * * *